US005144715A

United States Patent [19]

Matsuyo et al.

[11] Patent Number: 5,144,715

[45] Date of Patent: Sep. 8, 1992

[54] VACUUM CLEANER AND METHOD OF DETERMINING TYPE OF FLOOR SURFACE BEING CLEANED THEREBY

[75] Inventors: Tadashi Matsuyo, Youkaichi; Masahiro Kimura, Shiga; Hideo Okubo, Youkaichi; Seiji Yamaguchi, Shiga; Hiroshi Kawakami; Masaru Moro, both of Youkaichi, all of Japan

[73] Assignee: Matsushita Electric Industrial Co., Ltd., Osaka, Japan

[21] Appl. No.: 567,140

[22] Filed: Aug. 14, 1990

[30] Foreign Application Priority Data

Aug. 18, 1989 [JP] Japan ..... 1-213377
Aug. 18, 1989 [JP] Japan ..... 1-213378

[51] Int. Cl.[5] ..... A47L 5/00

[52] U.S. Cl. ..... 15/319; 15/339; 15/412

[58] Field of Search ..... 15/319, 339, 412

[56] References Cited

U.S. PATENT DOCUMENTS 4,601,082 7/1986 Kurz ..... 15/319
4,680,827 7/1987 Hummel ..... 15/319
4,920,605 5/1990 Takashima ..... 15/339 X
4,942,640 7/1990 Hayashi et al. ..... 15/319
4,958,406 9/1990 Toyoshima et al. ..... 15/319

FOREIGN PATENT DOCUMENTS 2336758 3/1974 Fed. Rep. of Germany ..... 15/319
2225933 6/1990 United Kingdom .

*Primary Examiner*—Chris K. Moore
*Attorney, Agent, or Firm*—Pollock, VandeSande & Priddy

[57] ABSTRACT

A vacuum cleaner and method for determining the kind of floor surface being cleaned by a vacuum cleaner wherein dust amount per unit interval is detected and dust detection change patterns are analyzed for determining floor type. This analysis is based on the following assumptions: smooth and carpet surfaces can be distinguished by dust detection patterns for an interval of several seconds. On the smooth surface, almost all of the dust at one place is picked up during an early stage of the interval. On the other hand, on a carpet floor, dust is picked up continuously. On a new carpet, many piles detach during vacuuming. Thus, if dust detection is continuous over several seconds it may be assumed that, the carpet is a new carpet.

7 Claims, 10 Drawing Sheets

VACUUM CLEANER AND METHOD OF DETERMINING TYPE OF FLOOR SURFACE BEING CLEANED THEREBY

BACKGROUND OF THE INVENTION

1. Field of the Invention

This invention relates to a vacuum cleaner and method of determining the type of floor surface being cleaned by a vacuum cleaner.

2. Description of the Prior Art

Hereinbelow will be described the general structure of a prior art vacuum cleaner with reference to FIG. 8.

FIG. 8 is a perspective view a prior art vacuum cleaner of, which is common to embodiments throughout this specification. In FIG. 8, an inlet 32 of a body 31 is connected to a hose 33, an extension tube 34, and a suction inlet 35. A handle switch 36 is provided to a tip of the hose 33. An operator controls the rotating speed of a blower motor 37 provided in the body 31 by operating the handle switch 36 in accordance with the kind of floor surface to be cleaned.

Therefore, in the prior art vacuum cleaner, there is a problem that the operator needs to manually change the suction force by operating the handle switch 36 in accordance with the kind of floor surface being cleaned.

SUMMARY OF THE INVENTION

The present invention has been developed in order to remove the above-described drawbacks inherent to the conventional vacuum cleaner and a method of determining the kind of floor surface being cleaned by a vacuum cleaner.

According to this invention there is provided a vacuum cleaner and a method for determining the floor surface being cleaned by a vacuum cleaner wherein dust amount per unit interval is detected and dust detection pattern changes are analyzed for determining floor type. This analyzing is based on the tendency as follows: smooth and carpet surfaces can be distingushed by dust detection pattern for an interval of several seconds. On the smooth surface, almost all of the dust at one place is picked up during an early stage of the interval. On the other hand, on a carpet floor, dust is picked up continuously. On a new carpet, many piles detach during sucking operation. Thus, if dust detection is continuous for over several seconds, the carpet can be determined to be a new carpet.

According to the present invention there is provided a method of determining the kind of floor surface being cleaned by a vacuum cleaner, comprising the steps of: (a) detecting dust amount for a first given interval in response to dust particles picked-from the surface by counting the number of detections of the dust particles passing through a portion in a suction passage of the dust particles; and (b) analyzing change pattern of the dust amount for a second interval to detect the kind of surface, the second given interval being shorter than the first given interval.

According to the present invention there is also provided a vacuum cleaner comprising: a blower motor; a dust detector responsive to portions of dust particles picked up due to rotation of the blower motor for producing a dust detection signal when detecting dust particles passing through a portion of a suction passage of the dust particles; a first counter responsive to the dust detection signal for counting the number of the dust particles for a first given interval; a first comparator responsive to an output of the first counter for comparing the number with a first reference number at the first given interval; a second counter responsive to an output of the first comparator for counting the number of occurrences of the output signal from the first comparator for a second given interval which is longer than the first given interval; a second comparator responsive to the second counter for comparing the number of the occurrences of the output signal of the second counter with a second reference number at the second given interval; and an input power controller responsive to an output signal of the second comparator for controlling input power of the blower motor in accordance with the output signal of the second comparator.

According to the present invention there is further provided a vacuum cleaner comprising: a blower motor; a dust detector responsive to a portion of the dust particles picked up from a surface of a floor due to rotation of the blower motor for producing a dust detection signal when detecting dust particles passing through a portion of a suction passage of the dust particles; a first counter responsive to the dust detection signal for measuring a first given interval during which time dust particles exist; a first comparator responsive to the first counter for comparing the count with a first reference number at the first given interval; a second counter responsive to an output of the first comparator for counting the number occurrences of the output signal from the first comparator for a second given interval which is longer than the first given interval; a second comparator responsive to the second counter for comparing the number of the occurrence of the output signal of the second counter with a second reference number at every second given interval; a determining circuit for determining that a floor being cleaned is a carpet whose piles are apt to detach by comparing a result of the second comparison obtained for one of the second given intervals with another result obtained for the following second given interval; and an input power controller responsive to an output signal of the second counter for controlling input power of the blower motor in accordance with a result of the determining means.

According to this invention there is further provided a method of determining the kind of surface of a floor being cleaned by a vacuum cleaner, comprising the steps of: (a) detecting dust amount for a first given interval in response to dust particles picked up from the surface by producing a count measuring an interval of detection of the dust particles passing through a portion of a suction passage; (b) comparing a counting result of step (a) with a first reference number at the first given interval; (c) counting events that the number exceeds a second reference number for a second given interval which is longer than the first interval; and (d) comparing the number of the events with a second reference number at the second given interval in response to the second counting of step (c) to determine the kind of surface.

According to this invention, there is also provided a method of determining the kind of surface of a floor being cleaned by a vacuum cleaner, comprising the steps of: (a) detecting dust amount for a first given interval in response to a dust particle picked up from the surface by counting the number of detections of the dust particles passing through a portion of a suction passage of the dust particles; (b) comparing a count of step (a)

with a first reference number at the first given interval; (c) counting events that the count of step (a) exceeds a second reference number for a second given interval; (d) comparing the number of the events with a second reference number at the second given interval in response to step (c), the second interval being longer than the first interval; and (e) comparing a result of step (d) obtained for one of the second given interval with another result obtained for the following second given interval to determine the kind of surface.

BRIEF DESCRIPTION OF THE DRAWINGS

The object and features of the present invention will become more readily apparent from the following detailed description taken in conjunction with the accompanying drawings in which.

The same or corresponding elements or parts are designated at like references throughout the drawings.

DETAILED DESCRIPTION OF THE INVENTION

Hereinbelow will be described a first embodiment of a vacuum cleaner of this invention.

Figure 8:
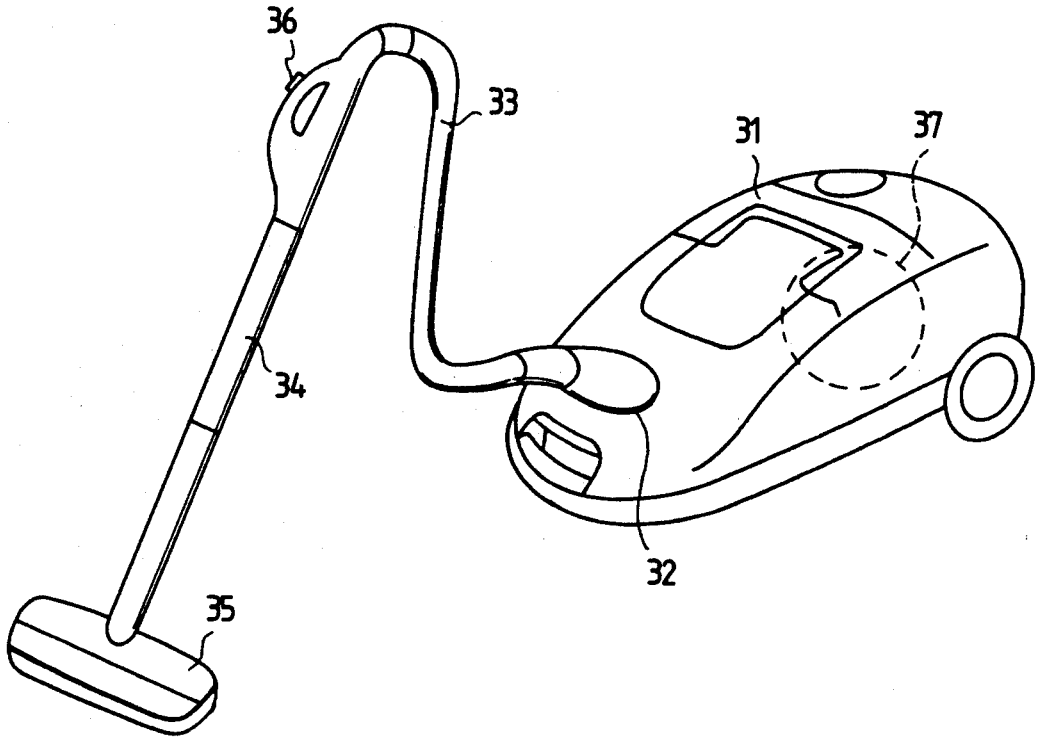
FIG. 8 is a perspective view of a vacuum cleaner of the first embodiment, which is common to embodiments throughout this specification and the prior art.

FIG. 8 shows the general structure of embodiments throughout the specification of an electric cleaner, which is also common to prior art vacuum cleaners. In FIG. 8, an inlet 32 of a body 31 is connected to a hose 33, an extention tube 34, and a suction inlet 35. A handle switch 36 is provided to a handle portion provided to a tip of the hose 33.

Figure 1:
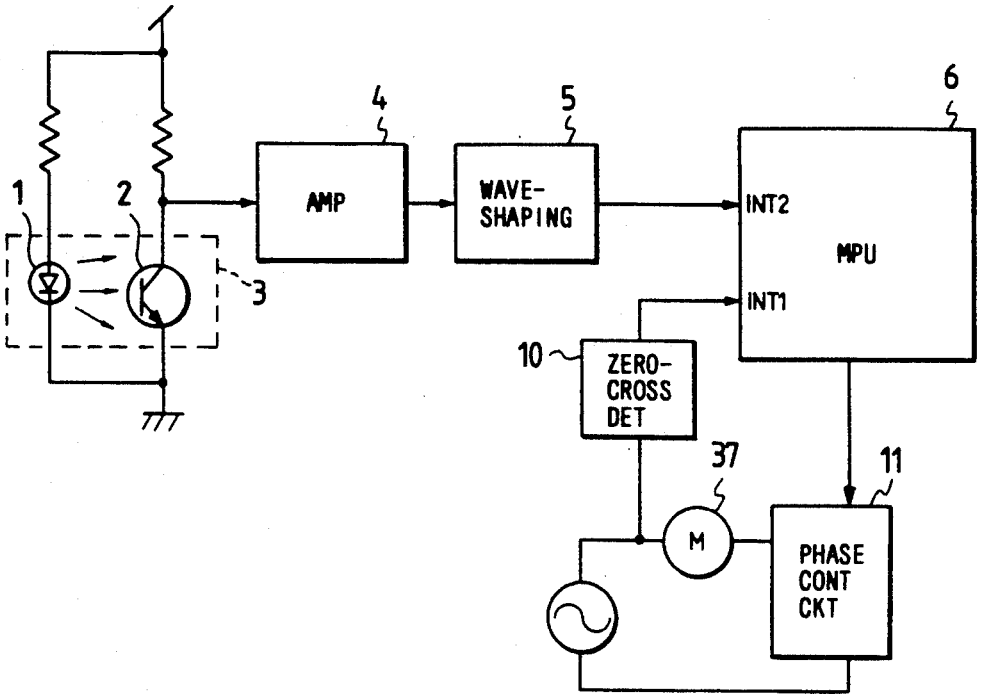
FIG. 1 is a block diagram of the first embodiment of a vacuum cleaner of this invention.
Figure 2:
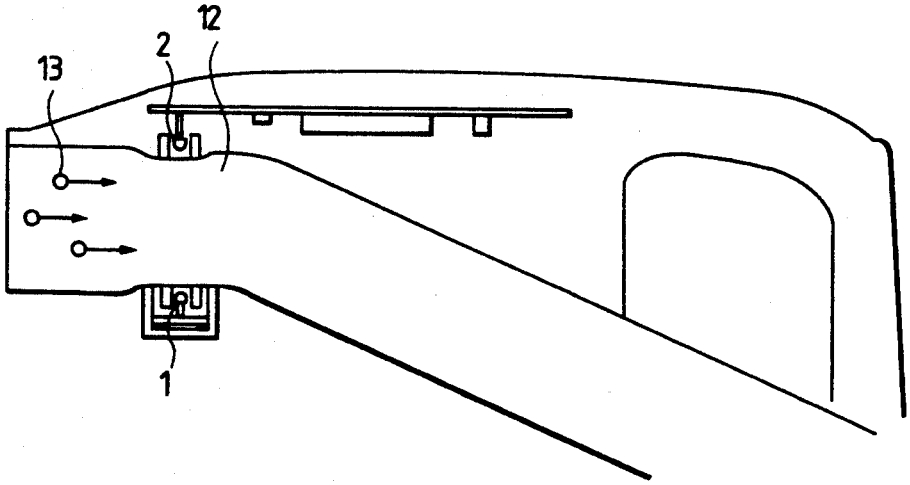
FIG. 2 is a cross-sectional view of a handle portion to show a dust sensor shown in FIG. 1.

FIG. 1 is a block diagram of the first embodiment of an electric cleaner of this invention, which is common to a second embodiment mentioned later. In FIG. 1, a dust sensor 3 produces a dust detection signal in response to dust passing therethrough. FIG. 2 is a cross-sectional view of the handle portion to show this dust sensor 3. In FIG. 2, a light emitting diode 1 is provided to an air passage 12 of the hose 33. A photodetector 2 is arranged such that the photodetector 2 confronts the light emitting diode 1 to receive light from the light emitting diode 1. This provides detection of light amount change by dust 13 passing through a portion of the air passage 12. The light emitting diode 1 and the photodetector 2 make up the dust sensor 3. An output of the photodetector 2 is amplified by the amplifier 4 and then wave-shaped by a wave-shaping circuit 5 to produce a dust detection pulse signal applied to a microprocessor 6. The dust detection pulse signal indicates interception of the light from the light emitting diode 1 to the photodetector 2. The wave-shaping circuit 5 comprises a level comparator. The microprocessor 6 produces a control signal for a phase control circuit 11 in response to the dust detection pulse signal through an INT 2 input and in response to an output of a zero-cross detector 10 through an INT 1 input. The zero-cross detector 10 detects zero-crossing of an ac line voltage. The phase control circuit 11 controls rotating speed of the motor 37 in response to the control signal from the microprocessor 6.

Figure 4A:
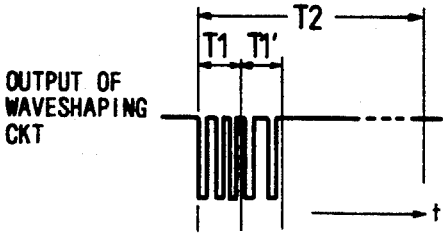
FIGS. 4A and 4B show dust detection pulse signal generation patterns of the first embodiment.
Figure 4B:
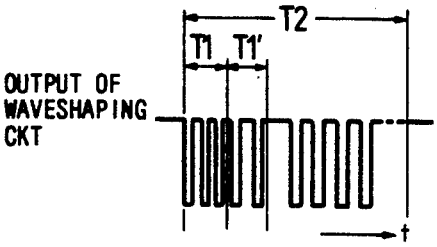
Figure 5:
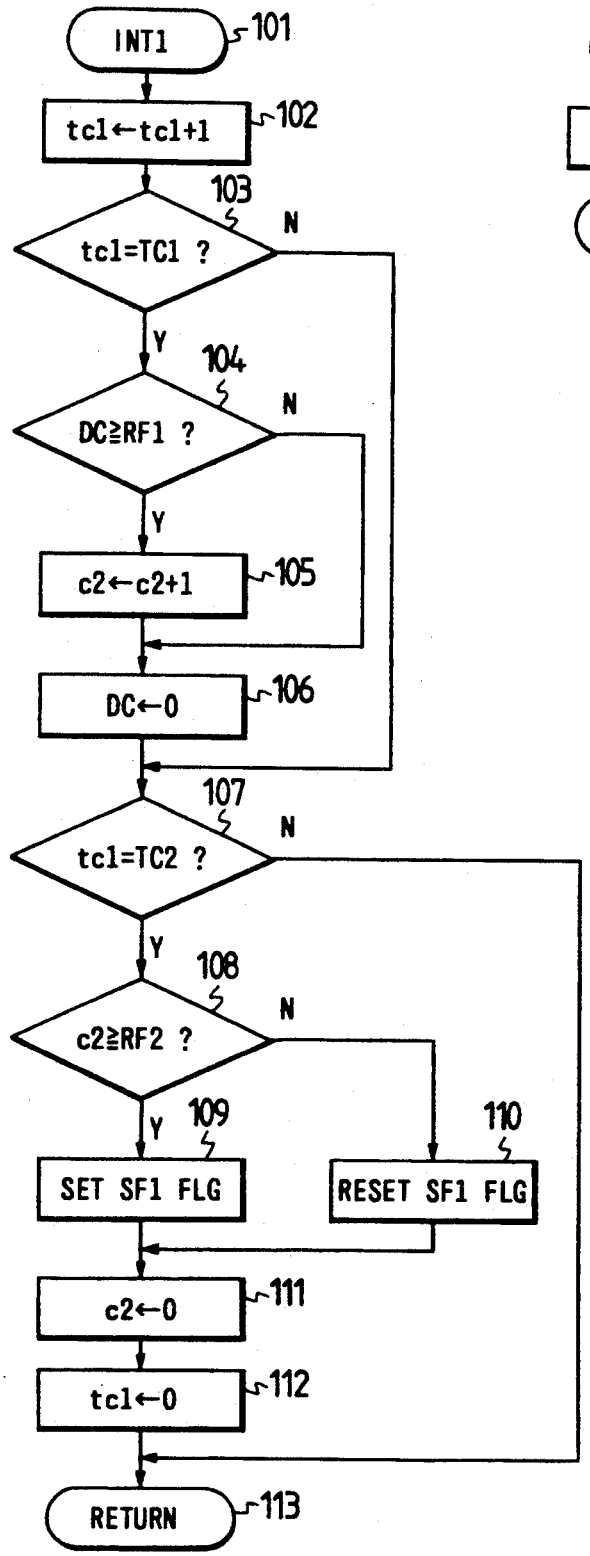
FIG. 5 shows a flow chart of the first embodiment.
Figure 6:
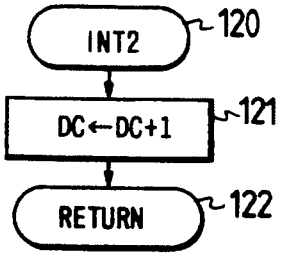
FIG. 6 shows another flow chart of the first embodiment, which is common to a second embodiment.

In the above-mentioned structure, operation will be described with reference to FIGS. 3A–3D to 7. FIGS. 3A to 3D show the relationship between a floor surface and dust detection signal generation patterns. FIGS. 4A and 4B show an output of the wave-shaping circuit 5 in the case of a smooth surface and a carpet surface respectively. FIGS. 5 and 6 show flow charts.

Figure 3A:
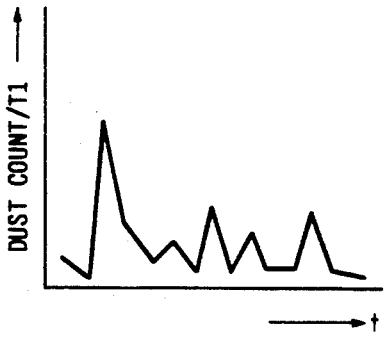
FIGS. 3A to 3D show the relationship between a floor surface and dust detection of the first embodiment.
Figure 3B:
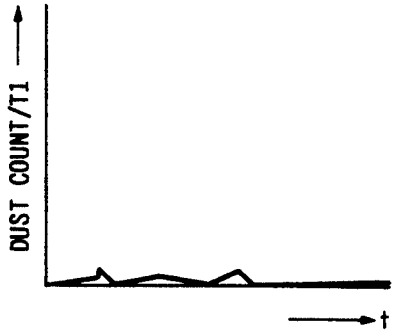

FIG. 3A shows the change of dust count per unit interval T1 in the case of a smooth surface (for example, wood surface) during a first suction operation; FIG. 3B shows change of dust count per unit interval T1 at a second suction operation at the same place. The change of dust count indicates the relative density of dust carried by the air through air passage 12 because there is a correspondence between the dust count per unit interval T1 and the amount of dust sucked up and carried by the air passing through air passage 12. This is due to the fact that the probability of two or more dust particles passing through the light beam from emitting diode 1 to photodetector 2 at the same instant of time is considered constant and that there is a relationship between the dust density and the number of the dust particles intercepting the light from light emitting diode 1 to photodetector 2. In the first suction operation, there is a relatively large amount of dust. However, during the second suction operation, there is a small amount of dust picked up. In the case of the "smooth floor surface", there is no continuity of dust detection because a first suction operation removes almost all of the dust. FIG. 4A shows the output of the wave-shaping circuit 5 in the case of the smooth surface. In FIG. 4A, dust detection is frequent for the early unit intervals T1 and T1'. However, there is little dust detection after the intervals T1 and T1' within the interval T2. This unit interval T1 is 0.1 second and the interval T2 is five seconds.

Figure 3C:
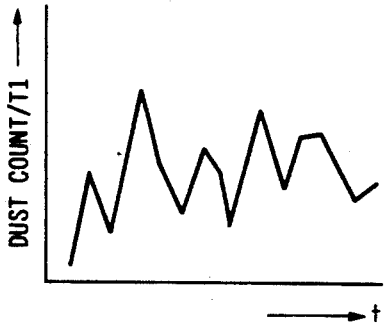
Figure 3D:
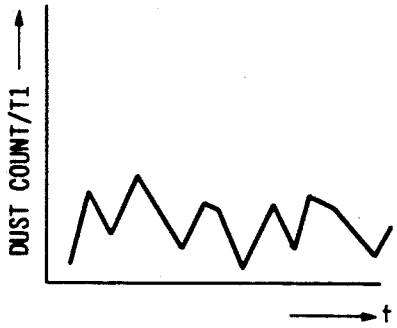

FIG. 3C shows dust counts per unit interval T1 counted at the first suction operation on a carpet and FIG. 3D shows dust counts per unit interval T1 at second suction operation on the carpet surface at the same place. As shown in FIG. 3C, there is a relatively large amount of dust in the case of "carpet surface" at a first suction operation. At a second suction operation, dust counts per unit interval T1 are still relatively many, as shown in FIG. 3D. In other words, dust is picked up continuously. FIG. 4B shows dust detection for interval T2 where dust detection is continuous. This floor surface detection method is based on the tendency that for several seconds, an operator cleans a floor with an electric cleaner at the same place. Thus, the kind of floor surface can be detected by analyzing a pattern of dust detection for this interval, i.e., the interval T2.

The above-mentioned operation is carried out by the microprocessor 6 in accordance with a stored program. The microprocessor 6 starts processing at power on and then initializes variations, flags, and its memory in the main routine and permits interrupts INT 1 and INT 2 when the operator starts cleaning. The microprocessor 6 starts processing of the flow chart of FIG. 5 in response to an output of the zero-cross detector through the INT 1 input. Therefore, a series processing of the flow chart of FIG. 5 is done at every half cycle of a power supply frequency. Thus, if the frequency of the power supply is 60 Hz, when the timer count tc1 counts twelve in step 102, 0.1 second has passed. On the other hand, the microprocessor 6 starts processing of a flow chart of FIG. 6 in response to the output of the wave-shaping circuit 5 through an INT 2 input for counting during a dust particle interval.

The microprocessor 6 starts INT 1 processing in step 101. In the following step 102, the microprocessor 6 increases a time count (counter) tc1 by one. In the succeeding step 103, a decision is made as to whether the time count tc1 is equal to a given value TC1 to detect whether one unit interval T1 has passed. If NO, processing returns to the main routine through steps 107 and 113. IF YES, i.e., the unit interval T1 has passed, processing proceeds to step 104. In step 104, a decision is made as to whether the dust detection count DC done by INT 2 is equal to or greater than a given reference value RF1 (for example two), as a first comparing means. If YES, the microprocessor 6 increases a count (counter) c2 as a second counting means by one in step 105. Processing proceeds to step 106. In step 104, if the answer is NO, processing proceeds to step 106 directly. In step 106, the microprocessor 6 clears the dust count DC. In the following step 107, a decision is made as to whether time count tc 1 is equal to a given interval TC2 which is equivalent to interval T2 in FIGS. 4A and 4B. If NO, processing returns to the main routine through step 113. If YES, processing proceeds to step 108. In other words, interval T2 has passed. In step 108, a decision is made as to whether the counter c2 is equal to or greater than a given value RF2 (for example, ten) as a second comparing means. If YES, the microprocessor 6 determines that the floor surface is a carpet surface and thus sets a surface flag SF1 in the following step 109. If NO, the microprocessor 6 resets the surface flag SF1 in step 110. In step 111 following steps 109 and 110, the microprocessor 6 clears the counter c2 and in the next step 112, the microprocessor 6 clears the time count tc1. In the succeeding step 113, processing returns to the main routine.

More specifically, in step 103, if the unit interval TC1 (T1) has passed, the microprocessor 6 checks to determine if the dust count (dust counter) DC is equal to or greater than a given value RF1 in step 104. If the count value is equal to or greater than a given value RF1 (for example, two), the microprocessor 6 increases the count c2 (counter c2) by one in step 105 and clears the count of the dust counter DC. If the dust count DC is less than the given value RF1 in step 104, nothing is done for the counter c2 and the microprocessor clears the dust counter DC in step 106. In step 107, if the given interval TC2 (T2) has passed, the microprocessor checks to determine if the counter c2 is equal to or greater than the reference value RF2 in step 107. If the counting value c2 is equal to or greater than a given value (for example, ten), the microprocessor determines that the floor surface is a carpet and sets a surface flag SF1 in step 109. In the following step 111, the microprocessor 6 clears the counter c2. If less than the given value RF2, the microprocessor determines that the floor surface is a smooth surface in step 108 and resets a surface flag SF1 in step 110. In the following step 111, the microprocessor 6 clears the counter c2. Then the microprocessor 6 ends interrupt processing INT1.

More specifically, input power controlling common to a second embodiment will be described.

Figure 16:
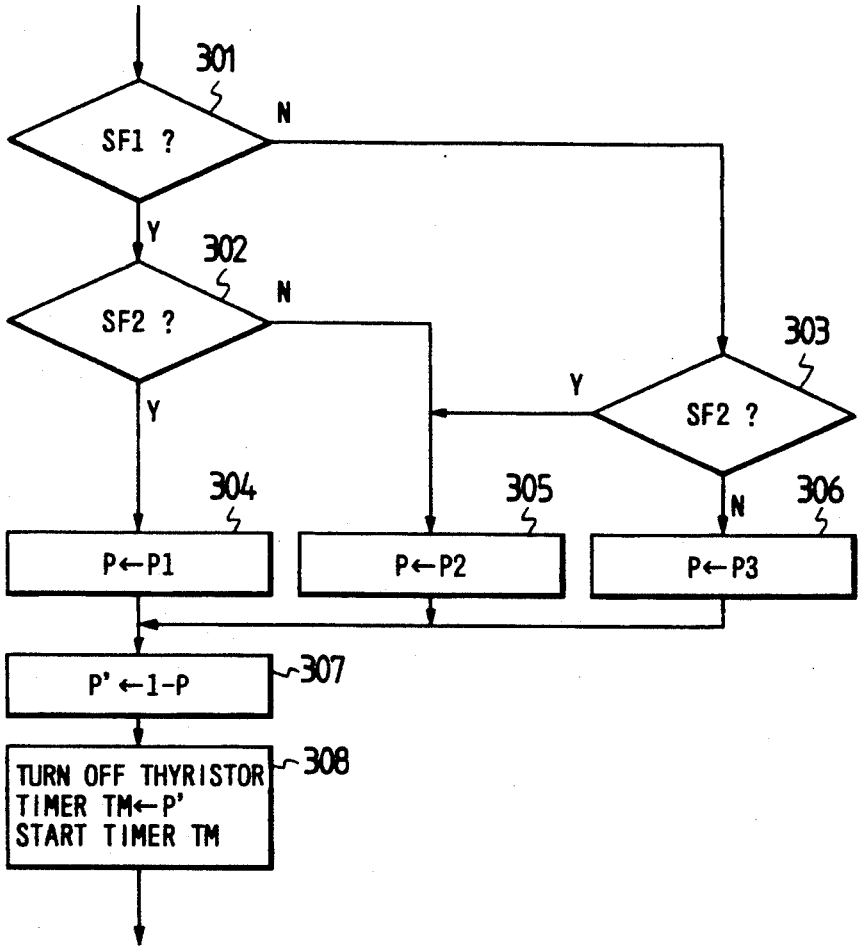
FIGS. 16 and 17 show flow charts used in the first and second embodiments.

The interrupt processing INT 1 of FIG. 5, responsive to the zero-cross signal includes a processing shown by a flow chart of FIG. 16 in the actual input power controlling with determination of floor surfaces. This processing is executed just before step 113 of FIG. 5. In FIG. 16, a decision is made as to whether the flag SF1 is set, in step 301. If YES, processing proceeds to step 302. In step 302, a decision is made as to whether the flag SF2 is set. If YES, i.e., the floor is a carpet with many piles detaching, processing proceeds to step 304. In step 304, an input power value P1 is set to a variable P. In the succeeding step 307, another input power value P' is obtained by subtracting the power variable P from one. The power value P' indicates off duration of the phase controlling circuit 11. Actually, the controlling circuit 11 comprises a bi-directional thyristor. In the following step 308, the power value P' is set to a timer TM. The timer TM included in the microprocessor 6 starts in response to the zero-cross detection signal and produces a signal for duty ratio control determined by the input power value P. In step 302, if the answer is NO, i.e., the surface is of a carpet which is not new, processing proceeds to step 305 where an input power value P2 is set to the variable P. Then processing proceeds to step 307 to control the timer TM, similarly. In step 301, if the answer is NO, i.e., the surface is not of a carpet, processing proceeds to step 303. In step 303, a decision is made as to whether the flag SF2 is set. If YES, i.e., the surface is not of a new carpet, processing proceeds to step 305 where the input value P2 is set to the variable P. Then processing proceeds to step 307 to control the timer TM, similarly. In step 303, the answer is NO, i.e., the surface is smooth, processing proceeds to step 306. In step 306, an input power value P3 is set to the variable P. These input power values P1, P2, and P3 indicate degrees of input power of the blower motor 37 and there is a relation that $P2>P3>P1$. Then, processing proceeds to step 307 to control the timer TM, similarly. In the first embodiment, the surface flag SF2 is not used. However, this flow processing can be used. In that case, only a flow from step 301, 302, to 305 and another flow from step 301, 303 and 306 are possible after processing step 301.

Figure 17:
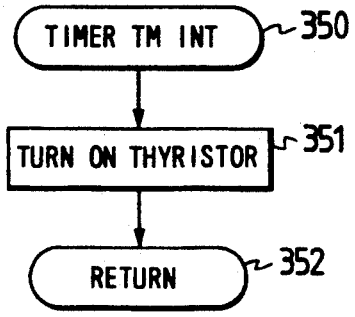

In response to timer TM interrupt, power control processing is carried out as shown FIG. 17. In FIG. 17, timer TM INT starts. In the following step 351, turn on of the thyristor occurs. Then, processing proceeds to step 102.

Figure 7:
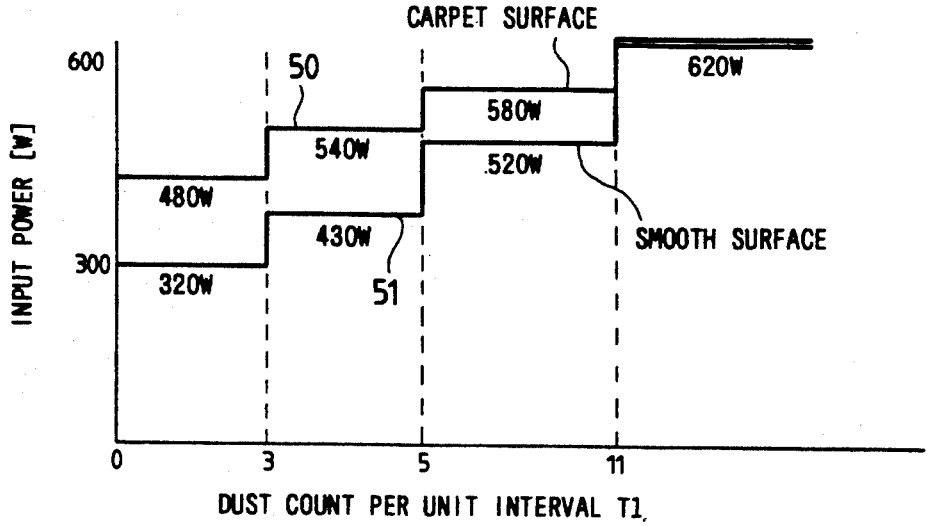
FIG. 7 is an explanatory drawing for one of the application examples of the method of the first embodiment.

As described, the kind of floor surface being cleaned can be determined automatically by the output of the dust sensor 3. Using this floor surface determining method, an application as shown in FIG. 7 is provided. There are two sets of rotating speeds of the blower motor. If the microprocessor 6 determines that the floor surface is a smooth surface, the input power of the blower motor is selected from the first set values, namely 320 W, 430 W, 520 W, and 620 W in accordance with dust count per unit interval T1 detected during a cleaning operation. On the other hand, when the microprocessor 6 determines that the floor is a carpet, the input power of the blower motor 37 is selected from the second set values, namely, 480 W, 540 W, 580 W, and 620 W in accordance with dust amount detected during a cleaning operation, as shown in FIG. 7.

In actual operation, at first, the microprocessor 6 determines the type of floor surface as described above and then the microprocessor 6 selects either set of input power values. Then, the microprocessor 6 controls the input power of the blower motor 37 by selecting an input power value from either set of input values in accordance with dust count per unit interval T1. These input power values are stored in a ROM table of the microprocessor 6 and these sets of the input power values are selected in accordance with the floor surface flag SF1.

Hereinbelow will be described a second embodiment of the invention.

General structure of the second embodiment of electric cleaner is the same as that of the first embodiment shown in FIG. 1. However, processing of the microprocessor 6 is different from that of the first embodiment.

Figure 10A:
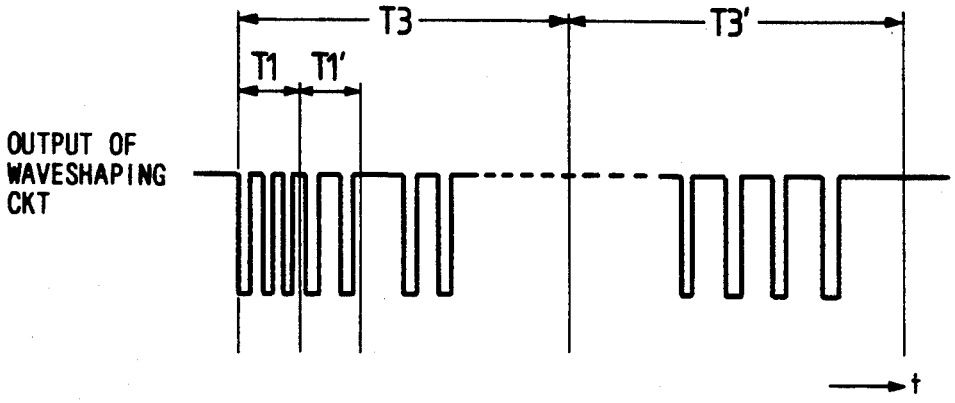
FIGS. 10A and 10B show a dust detection pulse signal of the second embodiment.
Figure 10B:
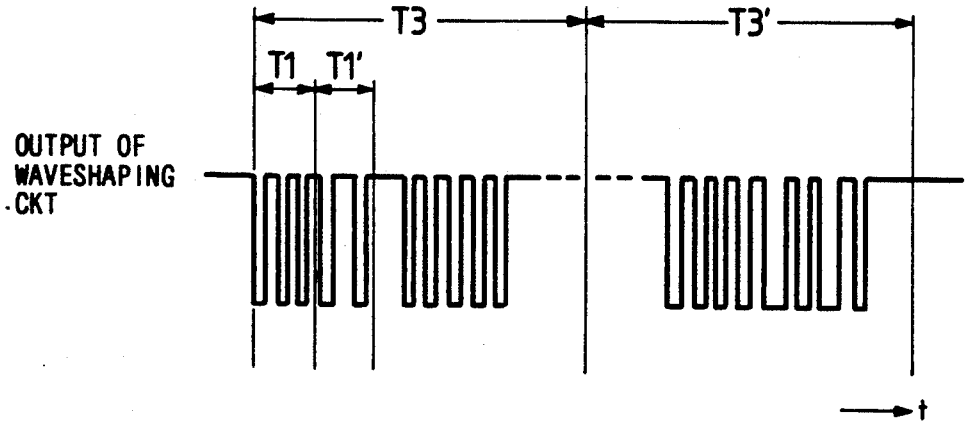
Figure 11:
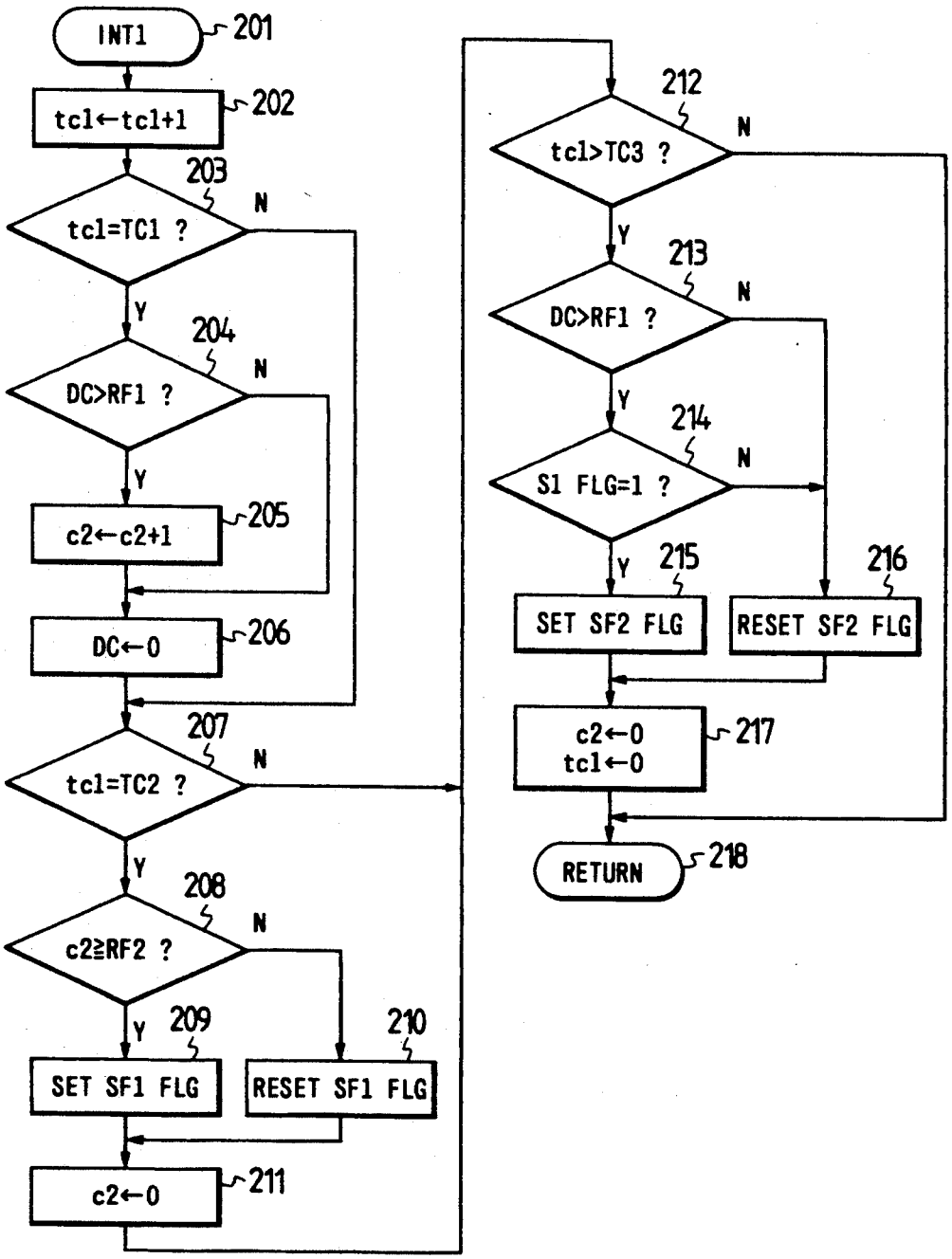
FIG. 11 shows a flow chart of the second embodiment.

FIGS. 9A to 9D show the relationship between kinds of floor surfaces and dust detection. FIGS. 10A and 10B respectively show an output of the wave-shaping circuit 5 in the case of a carpet surface and a carpet surface with a tendency of many piles to detach (new carpet). FIG. 11 shows a flow chart.

Figure 9A:
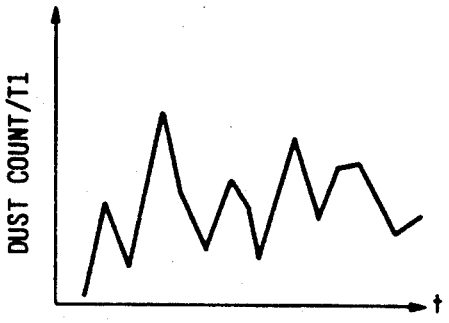
FIGS. 9A to 9D show the relationship between kinds of floor surfaces and dust detection of the second embodiment.
Figure 9B:
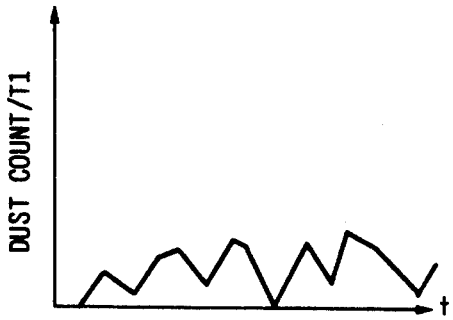

FIG. 9A shows the change of dust count per unit interval in the case of a carpet surface (non-new carpet) during a first suction operation; FIG. 9B shows a second suction operation at the same place. In the first suction operation, there is relatively much there. As shown in FIG. 10A, dust is relatively much dust in the case of the carpet surface. However, dust is cleaned by one suction operation to some extent for interval T3. For the following T3', dust is detected to some extent, i.e., there are fewer dust particles.

Figure 9C:
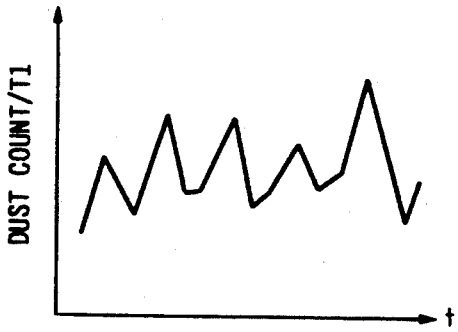
Figure 9D:
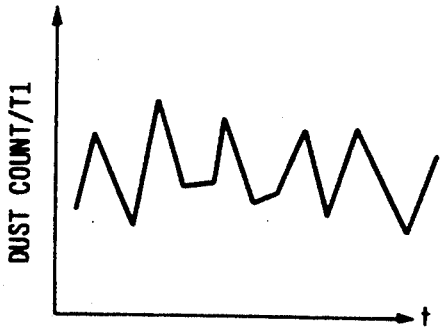

FIG. 9C shows the dust count per unit interval for a new carpet surface for a first suction operation; FIG. 9D shows a second suction operation at the same place. In the case of a carpet with a tendency of many prone piles to fall out such as a new carpet, the amount of dust detected is substantial for the first intervals T1 and T1' of interval T3 as shown in FIGS. 10A and 10B. During the following interval T3', there is almost no change in dust amount, and thus, there is continuity of dust detection because many piles fall out.

The operation is carried out by the microprocessor 6 in accordance with a stored program. The microprocessor 6 starts processing at power on and then initializes variations, flags, and its memory in the main routine and permits interrupts INT 1 and INT 2 when the operator starts cleaning. The microprocessor 6 starts processing of the flow chart of FIG. 11 in response to an output of the zero-cross detector through the INT 1 input. Therefore, a series processing of the flow chart of FIG. 11 is done at every half cycle of a power supply frequency. Thus, if frequency of the power supply is 60 Hz, when the timer count 9 counts twelve in step 102, 0.1 second has passed. On the other hand, the microprocessor 6 starts processing of the flow chart of FIG. 6 in response to the output of the wave-shaping circuit 5 through INT 2 input for counting dust particles as a first counting means.

The microprocessor 6 starts INT 1 processing in step 201. In the following step 202, the microprocessor 6 increases a time count (counter) tc1 by one. In the succeeding step 203, a decision is made as to whether the time count tc1 is equal to a given value TC1 to detect the passing of one unit interval T1. If NO, processing proceeds to step 212 through steps 207. IF YES, i.e., the unit interval T1 has passed, processing proceeds to step 204. In step 204, a decision is made as to whether the dust detection count DC done by INT 2 is equal to or greater than a given reference value RF1 (for example three), as a first comparing means. If YES, the microprocessor 6 increases a count (counter) c2, as a second counting means by one. Processing proceeds to step 206. In step 204, if the answer is NO, processing proceeds to step 206 directly. In step 206, the microprocessor 6 clears the dust count DC. In the following step 207, a decision is made as to whether time count tc 1 is equal to a given interval TC2 which is equivalent to interval T3 in FIGS. 10A and 10B. If NO, processing proceeds to step 212. If YES, processing proceeds to step 208. In other words, interval T3 has passed. In step 208, a decision is made as to whether the counter c2 is equal to or greater than a given value RF2 (for example, four), as a second comparing means. If YES, the microprocessor 6 determines that the floor surface is a new carpet and sets a surface flag SF1 in the following step 209. If NO, the microprocessor 6 resets the surface flag SF1 in step 210. In step 211 following steps 209 and 210, the microprocessor 6 clears the counter c2. The above-mentioned processing is similar to that of the first embodiment shown in FIG. 5 and is referred to as a first stage. A second stage is as follows:

In the following step 212, a decision is made as to whether the time count tc 1 is equal to a given interval TC3 to detect whether a first interval T1 has passed. If NO, processing proceeds to step 218. If YES, processing proceeds to step 213. In other words, an interval T3 has passed. In step 213, a decision is made as to whether the dust counter DC is equal to or greater than a given value RF1 (for example, four) again. If YES, a decision is made in the following step 214 as to whether an S1 flag is set. If YES, the microprocessor 6 sets a surface flag SF2 in the following step 215. This is a result of the second stage, namely that there are many piles detaching from the carpet. If NO, in steps 213 and 214, the microprocessor 6 resets the surface kind flag SF2 in step 216. In step 217 following steps 215 and 216, the microprocessor 6 clears the counter c2 and time counter tc1 and then, processing returns to the main routine through step 118.

As mentioned, if either results of the first or the second stage is the absense of many piles detaching, the floor is determined to be a non-new carpet. On the other hand, if both results of the first and second stages are of many piles detaching, the microprocessor 6 determines that the carpet is a new one.

Input power controlling of this embodiment is the same as that of the first embodiment, i.e., processing shown by the flow chart of FIG. 16. Thus, detailed description is omitted. In the second embodiment, this processing of FIG. 16 is executed just before step 218 of FIG. 11. In the first embodiment, the surface flag SF2 is not used. However, in the second embodiment, the surface flag SF2 is also used. Thus, there are four possible flows from the step 301, namely, flows passing steps 301-302-304, 301-302-305, 301-303-305, and 301-303-306.

In response to timer TM interrupt, power control processing is carried out as in shown FIG. 17 in the same way as to the first embodiment.

Figure 12:
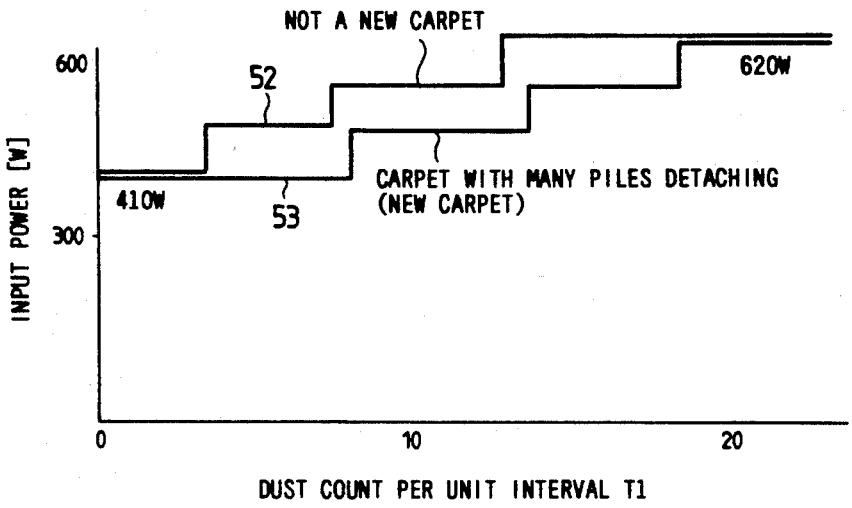
FIG. 12 is an explanatory drawing for one of the application examples of the method of the second embodiment.

As described above, determination of the floor being cleaned can be performed automatically with the output of the dust sensor. With this method of determining a floor surface, an application can be realized. This application is as follows:

The rotating speed of the blower motor 37 is controlled in accordance with the counting value of the dust counter DC or the amount of dust per unit interval is indicated in accordance with the counting value, using the dust counter DC before step 206 in the flow chart of FIG. 11. Another application as shown in FIG. 12 is provided. There are two sets 52 and 53 of rotating speeds of the blower motor. If the microprocessor 6 determines that the floor surface is a new carpet surface, the input power of the blower motor is selected from the first set values 53 in accordance with dust flow rate detected during a cleaning operation. On the other hand, when the microprocessor 6 determines that the floor is not a carpet, the input power of the blower motor is selected from the second set values 52 in accordance with dust rate detected during a cleaning operation.

In actual operation, at first, the microprocessor 6 determines the kind of floor surface as described above and then the microprocessor 6 selects either set of input power values. Then, the microprocessor 6 controls input power of the blower motor by selecting an input power value from either set of the input value in accordance with dust flow rate. These input power values are stored in a ROM table of the microprocessor 6 and these sets of the input power values are selected in accordance with floor surface flag SF2.

However, there is a better application as follows:

If the microprocessor 6 determines that the floor surface is a carpet with many piles detaching, the microprocessor 6 does not change input power; and the indication of dust amount does not change readily. This is because if input power and indication of dust amount is changed even in the case of the carpet with many piles detaching, suction operation is unlimited in time and there is a waste of time.

As described above, there is provided an electric cleaner with improved serviceability because it can determine a floor surface without manual operation and can control the blower motor in accordance with floor surface condition.

In the above-mentioned embodiment, determination is made for only a carpet. However, using the flow chart of FIG. 11, a smooth surface can be determined together with non-new carpet and new carpet surfaces. After processing shown in FIG. 11, the microprocessor 6 can determine the floor surface in accordance with flags SF1 and SF2 after INT 1 processing. If both flags SF1 and SF2 are reset, the floor is determined to be a smooth surface. If either of the surface flags is set, the surface is of a non-new carpet. If both surface flags SF1 and SF2 are set, the floor surface is of a new carpet. Another method is as follows:

At first, using the first embodiment, floor surface is determined and if it is a carpet, then determination of the second embodiment is carried out.

Hereinbelow will be described another embodiment of an electric cleaner of the invention.

Figure 13:
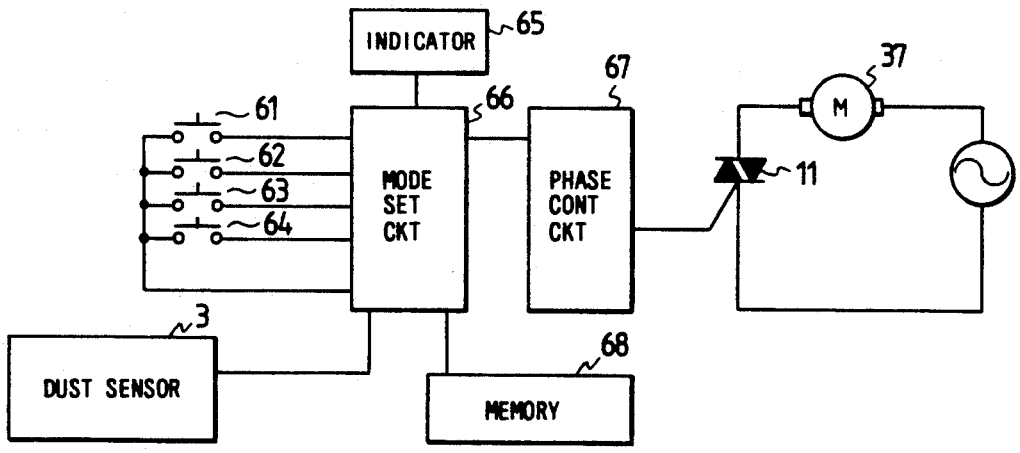
FIG. 13 is a block diagram of an electric cleaner of another embodiment.

FIG. 13 is a block diagram of an electric cleaner of the third embodiment. In FIG. 13, switches 61 to 64 are connected to a mode setting circuit 66 for setting operation modes. The mode setting circuit 66 changes operation mode in response to the switches 61 to 64. An indicator 65 is provided for indicating the operation mode and operation condition of a dust sensor 3. A phase controlling circuit 67 is provided for controlling conduction angle of the bi-directional thyristor 11 in response to an output signal of the mode set circuit 66 to drive a blower motor 37. A memory 68 is provided for storing operation modes in response to an output of the mode set circuit 66. These switches 61 to 64 are provided to a handle portion of the suction hose 33, as shown in FIG. 13.

Hereinbelow will be described operation of the electric cleaner of another embodiment.

Figure 14:
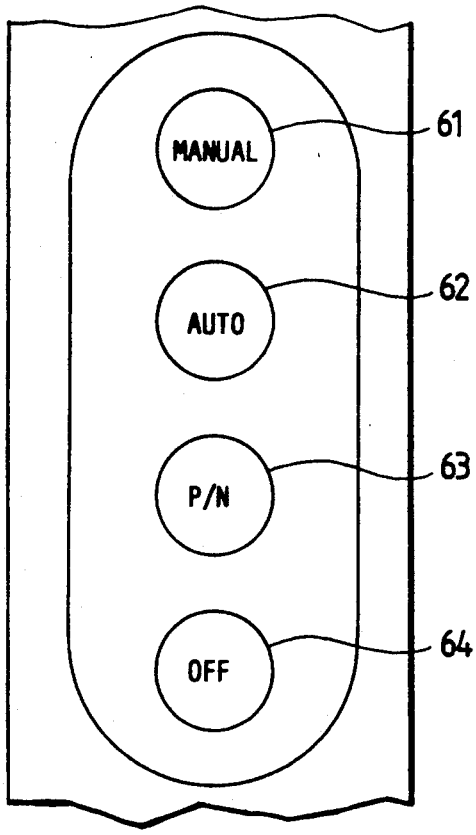
FIG. 14 is a schematic illustration for the switches arranged on the handle portion of another embodiment.

FIG. 14 is a schematic illustration for the switches arranged on the handle portion of the suction hose 33. When an operator closes the switch 61, a manual operation mode is selected by the mode set circuit 66 and the rotating speed of the blower motor 37 is fixed to a given value without dust detection control. The mode set circuit 66 selectes the rotating speed of the blower motor 37 and sends a gate signal for the bi-directional thyristor 11 through a phase control circuit 67 to drive the blower motor 37 at the given rotating speed.

When the operator selects an automatic operation mode with the switch 62, the mode set circuit 66 controls the rotating speed of the blower motor in accordance with dust detection amount per unit interval in response to an output of the dust sensor 3.

Figure 15:
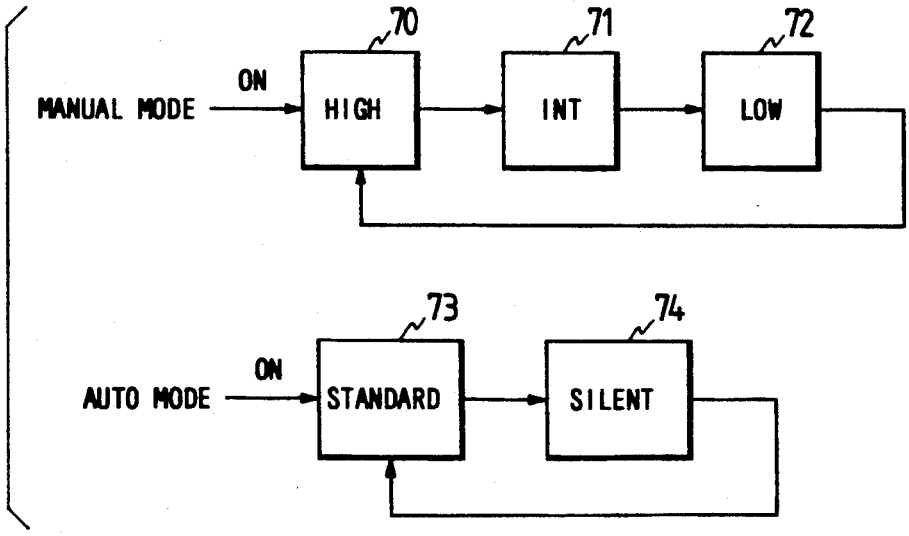
FIG. 15 is a schematic illustration for describing operation of another embodiment.

FIG. 15 is a schematic illustration for describing operation of another embodiment. The mode set circuit 66 changes the operation mode in response to closing of the switch 61 as shown in FIG. 15. That is, operation modes are changed in the order from HIGH 70, INTERMEDIATE 71, to LOW 72. The mode set circuit 66 changes the operation mode in response to closing of the switch 62 as shown in FIG. 15. That is, first closing of the switch causes the mode set circuit 66 to select an operation STANDARD 73 and second closing to select a SILENT mode 74. These modes are alternated with each other in response to the switch 62.

It is assumed that the blower motor rotates at a rotating speed RP. When the operator closes the switch 64 to interrupt operation of the vacuum cleaner, the blower motor 37 stops. When, the operator closes the switch 61 to resume operation of the cleaner, the mode set circuit rotates the blower motor 37 at the rotating speed RP. In other words, the mode set circuit 66 stores the rotating speed RP in the memory 68 in response to the switch 64. The mode set circuit 66 reads the stored rotating speed RS when starting a cleaning operation if a rotating speed is stored in the memory 68.

It is assumed that the operator selects automatic operation mode and the electric cleaner is operated in the silent mode. When the operator closes the switch 64 to stop a cleaning operation and then resumes operation by closing the switch 62, the mode set circuit 66 starts to control the blower motor 37 in the silent mode. In other words, the mode set circuit 66 stores the silent mode in the memory 68 in response to the switch 64. The mode set circuit 66 reads the stored mode at the beginning of a cleaning operation if a rotating speed is stored in the memory 68.

What is claimed is:

1. A vacuum cleaner, comprising:

(a) a blower motor being provided with input power at a variable level;

(b) dust detection means having a light emitting portion for emitting a light and a light sensitive portion for receiving the light from said light emitting portion, said light emitting and light sensitive portions being arranged to effect a light path therebetween across a portion of a suction passage of said vacuum cleaner for detecting interception of said light path by at least one dust particle crossing said light path to produce a dust detection signal;

(c) evaluation means responsive to said dust detection signal for equating the amount of dust particles passing through said suction passage as a succession of interception numbers representative of the number of times said light path is intercepted during each of a plurality of first given intervals;

(d) first comparing means for comparing said interception numbers with a first reference number for each of said first given intervals;

(e) counting means for counting the number of times said respective interception numbers are greater than said first reference number during a second given interval, said second given interval being longer than said first given interval;

(f) second comparing means for comparing the counted number of times said interception number is greater than said first reference number with a second reference number; and (g) power controlling means responsive to an output signal provided by said second comparing means for setting said input power level of said motor to be a first value when said counted number of times of said interception number being greater than said first reference number is equal to or greater than said second reference number, and to a second value when said counted number of times of said interception number is greater than said first reference number is smaller than said second reference number, said first value being different from said second value.

2. A vacuum cleaner, comprising:

(a) a blower motor being provided with input power at a variable level;

(b) dust detection means having a light emitting portion for emitting a light and a light sensitive portion for receiving the light from said light emitting portion, said light emitting and light receiving portions being arranged to effect a light path therebetween across a portion of a suction passage of said vacuum cleaner for detecting interception of said light path by at least one dust particle crossing said light path to produce a dust detection signal;

(c) evaluation means responsive to said dust detection signal for equating the amount of dust particles passing through said suction passage as an interception number representative of the number of times said light path is intercepted during a first given interval, a succession of respective interception numbers being obtained during each of a plurality of first given intervals;

(d) first comparing means for comparing said respective interception numbers with a first reference number for said first given interval;

(e) counting means for counting the number of times said respective interception numbers are greater than said first reference number for each of said plurality of second given intervals, said each second given interval being longer than said first given interval;

(f) second comparing means for comparing the counted number of times said respective interception numbers are greater than said first reference number with a second reference number at each said second given interval;

(g) means for determining a floor being cleaned is a carpet whose piles are prone to be detached when the counted number of times said interception number is greater than said first reference number obtained for one and a succeeding one of said second given intervals each are greater than said second reference number; and (h) power controlling means responsive to an output signal provided by said second comparing means for setting said input power of said motor to be a first value when said floor is determined to be said carpet, and to a second value when said floor is determined not to be said carpet, said first value being different from said second value.

3. A vacuum cleaner as claimed in claim 2, wherein said first value is larger than said second value.

4. A vacuum cleaner as claimed in claim 2, wherein said first value is smaller than said second value.

5. A method of distinguishing a surface of a floor being cleaned by a vacuum cleaner, comprising the steps of:

(a) arranging a light path between a light emitting means and a light sensitive means across a portion of a suction passage of said vacuum cleaner, said light emitting means emitting a light sensed by said light sensing means;

(b) producing a dust detection signal by detecting interception of said light path by at least one dust particle crossing said light path;

(c) evaluating said dust detection signal to equate the amount of dust particles passing through said suction passage as an interception number representative of the number of times said light path is intercepted for a first given interval, a succession of respective interception numbers being obtained during each of a plurality of first given intervals;

(d) comparing said respective interception numbers with a first reference number at said first given intervals;

(e) counting the number of times said respective interception numbers exceed a second reference number for a second given interval, said second reference number being experimentally predetermined from a tendency of an operator of said vacuum cleaner to continuously operate a suction inlet of said vacuum cleaner on the same area of said floor, said second given interval being greater than said first given interval; and (f) comparing said respective interception numbers with said second reference number for said second given interval in response to the number of times said respective interception numbers are counted to exceed said second reference number in step (e), wherein said surface is determined to be a carpet when said respective interception numbers exceed said second reference number.

6. A method of distinguishing a surface of a floor being cleaned by a vacuum cleaner, comprising the steps of:

(a) arranging a light path between a light emitting means and a light sensitive means across a portion of a suction passage of said vacuum cleaner, said light emitting means emitting a light sensed by said light sensing means;

(b) producing a dust detection signal by detecting interception of said light path by at least one dust particle crossing said light path;

(c) evaluating said dust detection signal to equate the amount of dust particles passing through said suction passage as an interception number representative of the number of times said light path is intercepted for a first given interval, a succession of respective interception numbers being obtained during each of a plurality of first given intervals;

(d) comparing said respective interception numbers with a first reference number at said respective first given intervals;

(e) comparing said respective interception numbers with a second reference number for a second given interval, said second reference number being experimentally predetermined from a tendency of an operator of said vacuum cleaner to continuously operate a suction inlet of said vacuum cleaner on the same area of said floor, said second interval being longer than said first given interval;

(f) counting the number of times said respective interception numbers exceed said second reference number for plurality of second given intervals; and (g) comparing the counted number obtained for one of said second given intervals in step (f) with the counted number obtained for the succeeding one of said one second given interval to determine whether said surface is a carpet whose piles are prone to be detached, wherein said surface is determined to be a carpet when the respective counted number of times obtained for said one and said succeeding one of said second given intervals each are greater than said second reference number.

7. A method of distinguishing a surface of a floor being cleaned by a vacuum cleaner, comprising the steps of:

(a) arranging a light path between a light emitting means and a light sensitive means across a portion of a suction passage of said vacuum cleaner, said light emitting means emitting a light sensed by said light sensing means;

(b) producing a dust detection signal by detecting interception of said light path by at least one dust particle crossing said light path;

(c) evaluating said dust detection signal to equate the amount of dust particles passing through said suction passage as an interception number representative of the number of times said light path is intercepted for a first given interval, a succession of respective interception numbers being obtained during each of a plurality of first given intervals;

(d) comparing said respective interception numbers with a first reference number at respective said first given interval;

(e) counting the number of times said respective interception numbers are greater than a second reference number for a second given interval, said second reference number being experimentally predetermined from a tendency of an operator of said vacuum cleaner to continuously operate a suction inlet of said vacuum cleaner on the same area of said floor, said second given interval being longer than said first interval;

(f) distinguishing said surface of said floor in accordance with the results of step (e) obtained for two consecutive second given intervals.

* * * * *